US005224744A

United States Patent [19]

Michelutti

[11] Patent Number: 5,224,744

[45] Date of Patent: Jul. 6, 1993

[54] DEVICE FOR LOCKING A COVER ON A CONTAINER AND A CONTAINER HAVING SUCH A DEVICE

[75] Inventor: Patrice Michelutti, Lyons, France

[73] Assignee: Compagnie Plastic Omnium, Lyons, France

[21] Appl. No.: 869,782

[22] Filed: Apr. 16, 1992

[30] Foreign Application Priority Data

Apr. 17, 1991 [FR] France ..... 91 04715

[51] Int. Cl.[5] ..... E05C 3/00; B65F 1/12

[52] U.S. Cl. ..... 292/234; 220/908; 414/414; 292/230

[58] Field of Search ..... 220/908; 292/230, 234, 292/205, 228; 414/414

[56] References Cited

U.S. PATENT DOCUMENTS

| | | | |
|---|---|---|---|
| 3,043,617 | 7/1962 | Shelton | 292/230 |
| 4,155,584 | 5/1979 | Pracchia | 414/414 |
| 4,182,530 | 1/1980 | Hodge | 292/228 |
| 5,015,021 | 5/1991 | Wyson et al. | 292/230 |
| 5,094,358 | 3/1992 | Serio, Sr. | 220/908 |
| 5,094,487 | 3/1992 | Drewry | 292/205 |
| 5,118,000 | 6/1992 | Howell et al. | 220/908 |
| 5,149,153 | 9/1992 | Drewry et al. | 220/908 |

*Primary Examiner*—Eric K. Nicholson

*Attorney, Agent, or Firm*—Schweitzer Cornman & Cross

[57] ABSTRACT

A device for locking a cover on a container body, particularly a wheeled barrel, having a locking piece mounted to pivot between a position assuring the locking of the cover in the closed position on the body and an unlocking position releasing the cover, and an operating member cooperating with the locking piece to bring the locking piece to an unlocking position for a predetermined inclined position of the container. The operating member is a movable weight (13) mounted for guided sliding movement, and the locking piece (11) and the operating member (13) comprise cooperating projecting means (24, 23) arranged so that a translatory movement in one direction (20) of the operating member produces a rotation of the locking piece (11) in the unlocking direction (21).

6 Claims, 3 Drawing Sheets

DEVICE FOR LOCKING A COVER ON A CONTAINER AND A CONTAINER HAVING SUCH A DEVICE

BACKGROUND OF INVENTION

The present invention relates to a device for locking a cover on a container, particularly a wheeled container, and to a container, which has at least one such device and is usable, in particular, for the mechanized collection of waste, particularly household waste.

For containers of this kind, which are designed to remain for a period of varying length on the public roadway both when empty and when full, it is desirable to keep the cover closed and locked onto the barrel to bar the access of unauthorized persons to the interior of the barrel, to prevent material being removed by such people from the barrel out of sense of mischief or a desire to salvage or place waste other than that authorized being placed in the barrels, particularly in a system of waste recycling.

It has already been proposed to equip such containers with a cover locking device, which can be operated with a key, particularly a personalized key.

This solution is not entirely satisfactory because, the person performing the collection must be able to open the cover without having the key that unlocks it.

Furthermore, U.S. Pat. No. 4,155,584 discloses a device for locking a cover on a container, particularly a wheeled container. This device has a latch, which is mounted so as to pivot between a position, in which it locks the cover closed on the barrel, and an unlocked position, in which it releases the cover. It furthermore has an operating means, which cooperates with said latch to bring the latch into the unlocked position when the container is in a predetermined inclined position.

In this publication, the operating means consists of a movable weight, which rolls along a curved track, and is connected by a linkage to a pivoting latch.

SUMMARY OF THE PRESENT INVENTION

It is an object of the present invention to provide a locking device, which has a less bulky structure and a less complex motion and therefore will be less fragile and more reliable than the former device.

For this purpose the inventive device is characterized essentially by the fact that said operating means is a movable weight mounted for a guided sliding motion, and that said latch and said operating means comprise projecting cooperating means, which are arranged so that a translatory movement of the operating means in one direction causes a rotation of the latch in the unlocking direction.

It can be understood that, pursuant to the invention, the operating means is in direct engagement with the latch and can be operated, on the one hand, by a traditional actuating means, such as an appropriate key, particularly a personalized key and, on the other, when the container's orientation is changed, as is the case particularly when the container is raised and turned in order to dump its contents into a collecting truck.

The latch is then shifted to the unlocking position, thus releasing the cover, which opens under its own weight and under the weight of the waste that may be present in the barrel.

In a preferred embodiment of the invention, the operating means comprises a movable weight, which is provided with guiding means.

The invention will be better understood from the description below of an embodiment thereof and from the appended drawing, in which:

DETAILED DESCRIPTION OF THE INVENTION

In FIGS. 1 to 8, the same reference numbers have been used to identify the same elements.

Figure 1A:
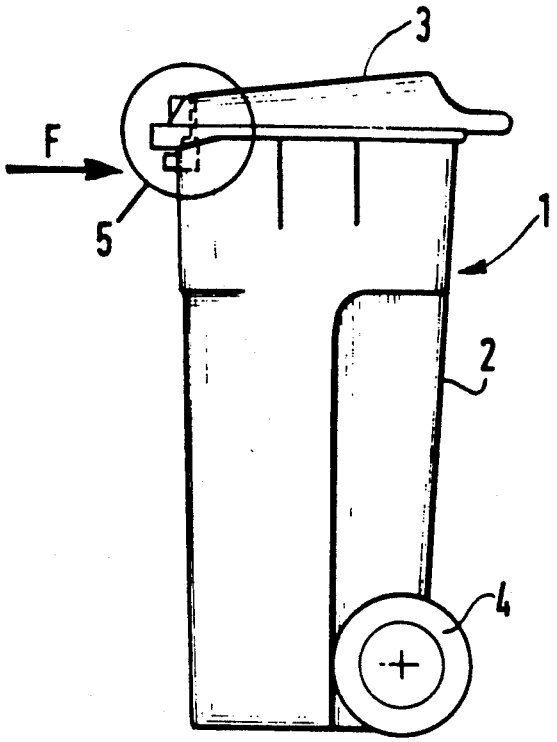
FIGS. 1*a* and 1*b* are schematic views of a container in the form of an inventive wheeled barrel.
Figure 1B:
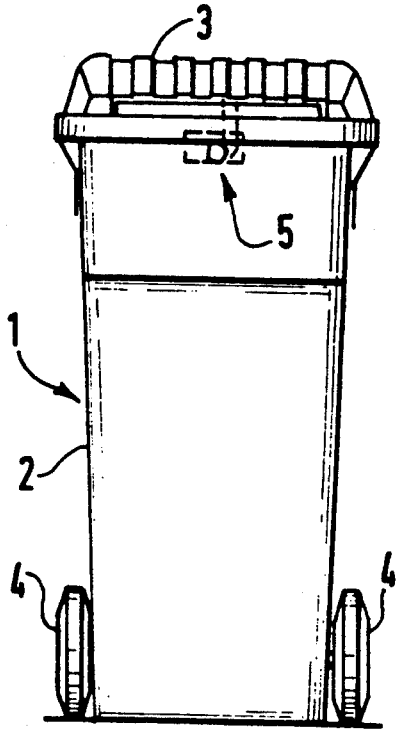

FIG. 1*a* shows a side view of an example of an inventive wheeled barrel 1. The same barrel is shown in a front view in FIG. 1*b*. The barrel 1 has a body 2 and a cover 3. In the unrestricted example shown, the body 1 has a pair of wheels 4, which are disposed at the bottom of the body. It is well understood that other types of wheeled containers, particularly large-capacity containers having, for example, four wheels at the bottom, are not outside the scope of the present invention.

The inventive body 1 has a device 5 for locking the cover 3 on the body 2.

Figure 2:
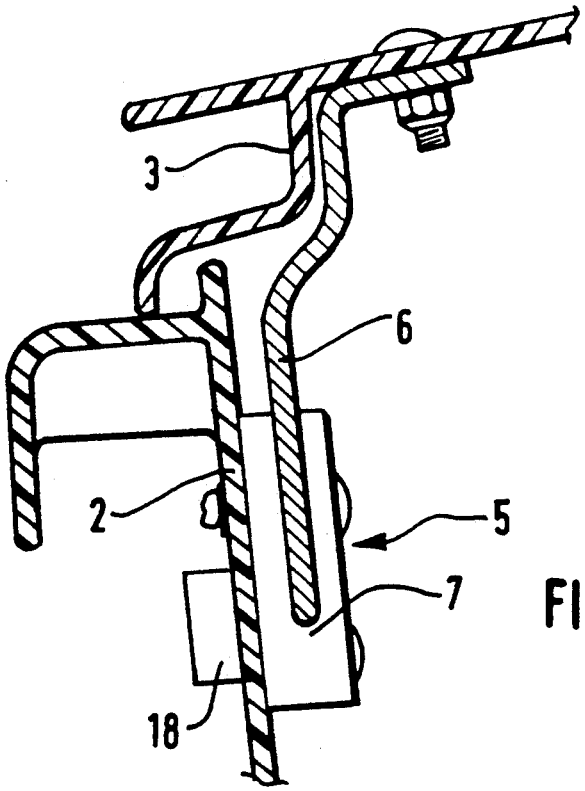
FIG. 2 is a schematic sectional view of an embodiment of the inventive locking device.

FIG. 2 shows an example of the embodiment of the inventive locking device 5. The device 5 has a catch 6 affixed to the cover 3. In the example shown, the catch 6 is bolted onto the cover 3. The catch 6 penetrates into a lock 7, which is mounted on the container body.

Figure 3:
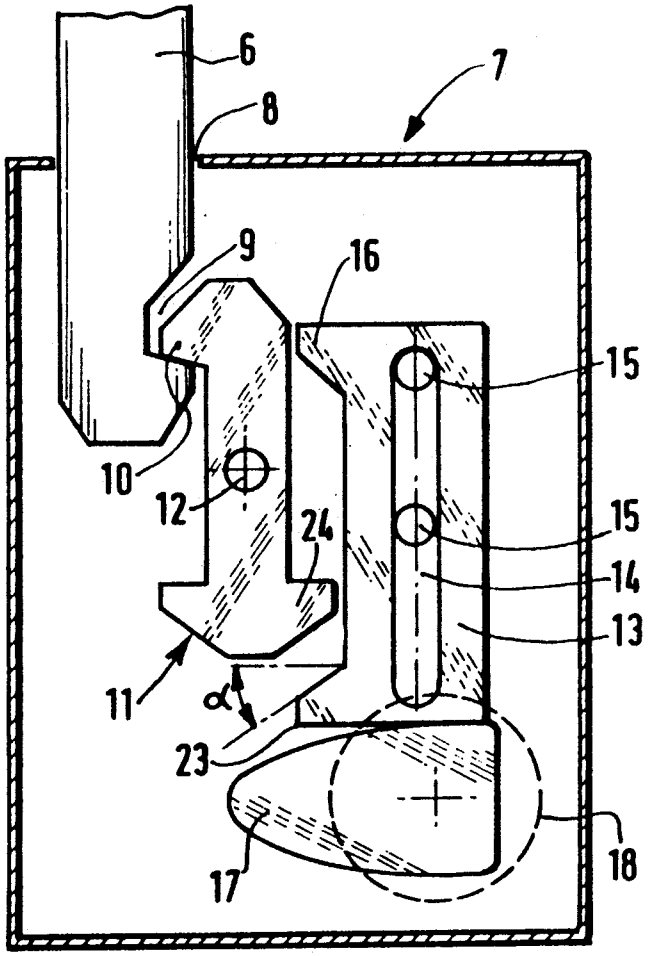
Figure 8:
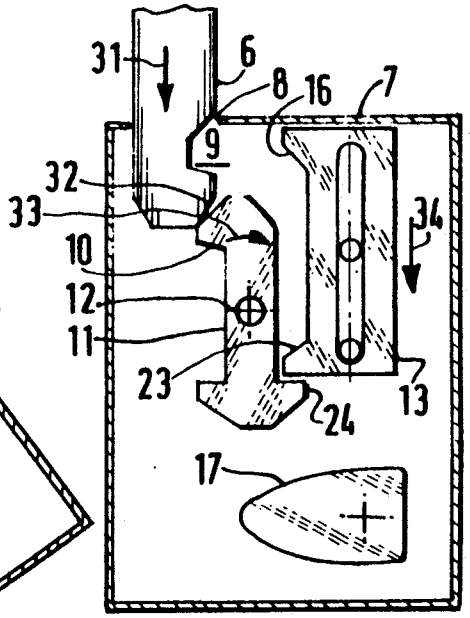
FIG. 8 is a schematic showing the operation of the inventive locking device during the movement of the return of the barrel to its position of rest.

FIG. 3 shows the catch 6 penetrating through an opening 8 into the interior of the lock 7. As its extremity, the catch 6 has a notch 9, into which penetrates a locking means, such as a projection 10 of an operating means, such as a latch 11, which turns about an axis 12. The lock 7 contains a mobile weight or slider 13, into which studs 15 enter to guide its movement. The central slot 14 is substantially vertical, when the wheeled barrel is in its position of rest (FIG. 3). On its upper portion, the slider 13 has the projection 16, which, in this position of rest, prevents the rotation of the latch 11 and thus the release of the catch 6.

Figure 4:
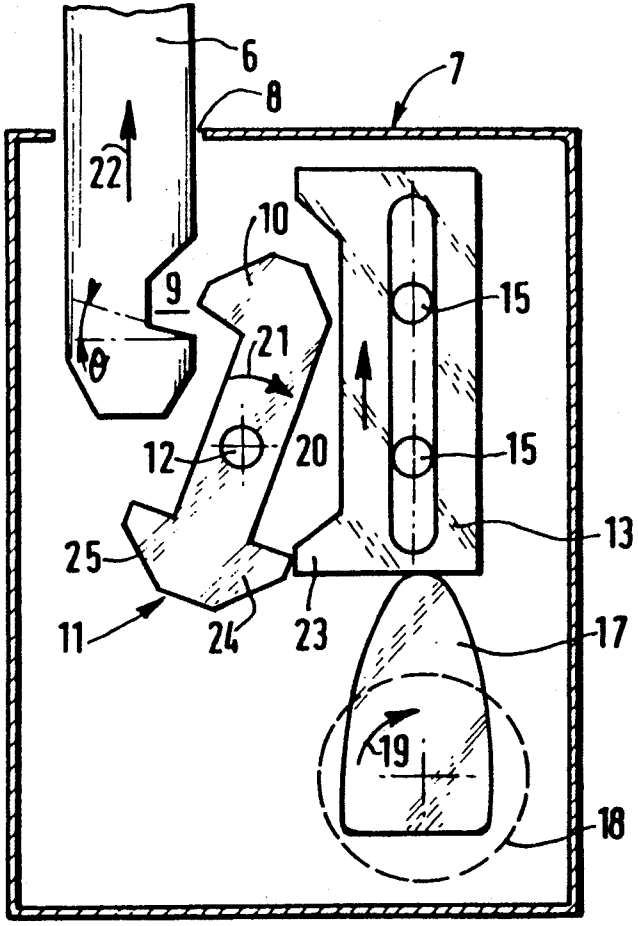
FIGS. 3 and 4 are schematics illustrating the operation of the inventive locking device and show it in a locked configuration and in a position unlocked by the operating means, respectively.

The lock 7 contains a cam 17, the rotation of which produces the substantially vertical movement of the slider 13 into the position of rest of the wheeled barrel, that is, from the position shown in FIG. 3 to that shown in FIG. 4. This rotation is produced, for example, by means of a key inserted by the user of the barrel 1 into the keyhole 18.

The release of the lock 7 is illustrated in FIG. 4. Under the action of the key (not shown in the Figure), the cam 17 rotates in the direction of the arrow 19 and produces the upwards movement of the slider 13 in the direction of the arrow 20. In this position, the projection 16 of the slider 13 no longer blocks the rotation of the latch 11, which can then turn about the axis 12 in the direction of the arrow 21. Since the projection 10 of the latch 11 is no longer engaged in the notch 9 of the catch 6, the latter is free to exit from the lock 7 in the direction of the arrow 22. Consequently, it is possible to raise the cover.

It is particularly advantageous that the rotation of the latch 11 is produced automatically by the action of the key turning the cam 17. In the example shown, the slider 13 has a lower projection 23, while the latch 11 has a lower projection 24. As a result of the movement of the slider 13, which is produced by the rotation of the cam 17, the projection 23 comes into contact with the projection 24. The contact surface is, for example, substantially flat and set at an angle to the horizontal, the slope running from the axis of the slider toward the edge. Continuing its movement, the slider 13 causes the latch 11 to rotate about the axis 12 and thus produces the automatic release of the catch 6.

Thus, when the projection 16 of the slider 13 is not blocking the rotation of the latch 11, a pull of the catch 6 in the direction of the arrow 22 by means of the cover 3, produces the rotation of the catch 11 about the axis 12.

In the example of the embodiment shown, the catch 11 has a lower projection 25, which is substantially symmetrical to the projection 24 in relation to a vertical plane. The projection 25 provides for the equilibrium of the latch 11 and the projection 10 of latch 11 tends to move into the notch 9 in the catch 6.

Figure 6B:
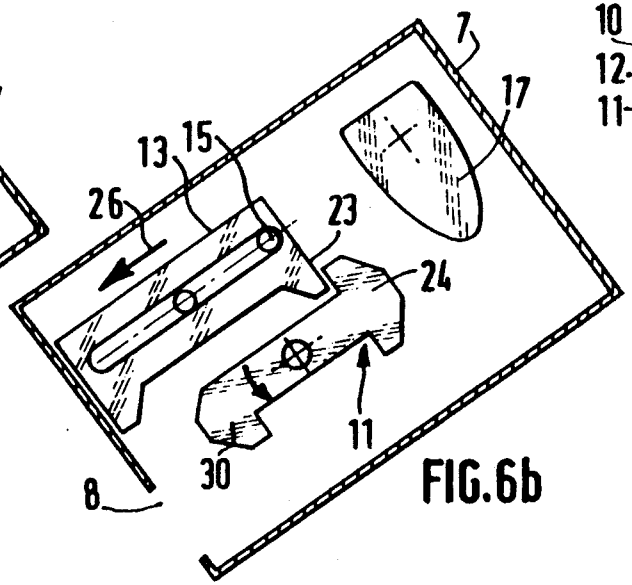
FIGS. 6*a* and 6*b* are schematics showing the operation of the inventive locking device during the automatic unlocking, when the barrel assumes an inclined position for emptying.
Figure 5:
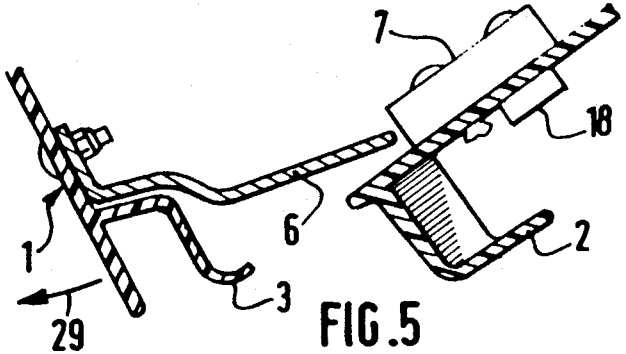
FIG. 5 is a schematic view of the barrel of FIG. 1 when the barrel is tilted for emptying.
Figure 6A:
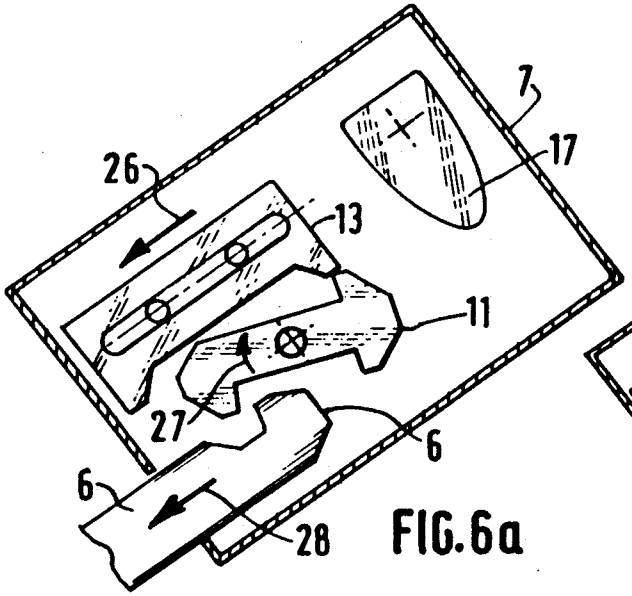

Referring now to FIGS. 5, 6*a* and 6*b*, the change to the inclined, dumping position shown in FIG. 5 is brought about by inverting the wheeled barrel 1. This operation is typically performed by a mechanism, which seizes and swings the barrel over a mechanized collection truck, which is not shown. As soon as the vertical axis of the wheeled barrel 1 has undergone a rotation greater than 90°, and as shown in FIG. 6*a*, the slider 13 slides under the action of its weight in the direction of the arrow 26, latch 11 is caused to rotate in the direction of the arrow 27. The catch 6 is released and shifted in the direction of the arrow 28 simultaneously with the opening of the cover 3 in the direction of the arrow 29 (FIG. 5).

As it can be seen in FIG. 6*b*, the slider 13 continues its course in the direction of the arrow 26 until it abuts against the studs 15 and/or against the case of the lock 7. When the projection 23 of the slider 13 has passed the projection 24 of the latch 11, the latter performs a rotation in the direction of the arrow 30, which is the opposite direction to the one, which permits the release of the catch 6. The batch 11 holds the slider 13 by its projection 24 in the end position reached by the latter during its preceding movement in the direction of the arrow 26.

Figure 7:
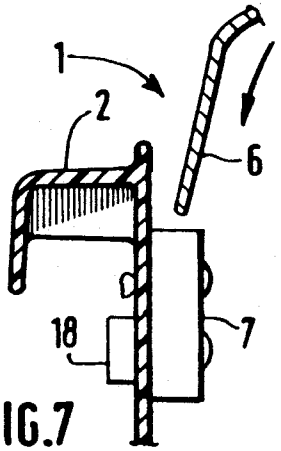
FIG. 7 is a schematic view similar to that of FIGS. 1 and 5 during the movement of the return of the barrel to its position of rest.

FIG. 7 corresponds to a position of the wheeled trash barrel 1 during its return movement after having dumped its contents, with the cover open. The slider 13 is in the high position and its projection 23 rests on the projection 24 of the latch 11. As the cover closes and when the catch 6 enters the opening 8 in the direction of the arrow 31, a ramp 32 on the end of the catch 6 pushes back the latch 11 at its upper projection 10. The latch 11 turns on the axis 12 in the direction of the arrow 33. The projection 24 of the latch 1 withdraws and permits the slider 13 to fall back in the direction of the arrow 34 and the projection 10 of the latch 11 to enter the notch 9 of the catch 6. The device is back in its starting position shown in FIG. 3, in which the upper projection 16 of the slider 13 prevents the rotation of latch 11 and locks the catch 6.

The invention applies mainly to wheeled barrels for the collection of industrial and/or household waste and, particularly to wheeled barrels, which have a body that may or may not be partitioned and one or more covers, which especially permit selective collection, the cover or each cover being equipped with a locking device as described above.

I claim:

1. A compact device for locking a cover on a refuse container body, comprising a flat locking piece (11) mounted for pivoting between an initial position assuring the locking of the cover in the closed position of the container and an end position of unlocking for releasing the cover, and a flat operating means (13), which directly engages said locking piece in a common plane to bring the locking piece into an unlocked position at a predetermined inclined position of the container, wherein said operating means is a flat mobile weight (13) which is mounted for a guided translatory linear sliding movement in said common plane, and that said locking piece (11) and said operating means (13) include cooperating canted projecting means (24, 23) arranged in said common plane so that a linear translatory movement in one direction (20, 26)of the operating means produces a rotation of the locking piece (11) in the unlocking direction (21, 27).

2. A device of claim 1, characterized in that the locking piece is a latch (11), which pivots about an axis (12) and, at its upper end, has a projection (10) that engages in the locking position a notch (9) at the bottom end of a catch (6) affixed to the cover (3).

3. A device of claim 1, characterized in that it comprises a means, such as a cam (17), which cooperates with the operating means (13) to move the latter in translation, said cam being operable by an actuating means such as a personalized key.

4. A device of claim 1, characterized in that the operating means (13) comprises a means, such as a projection (16), which prevents any disengagement of the locking piece (11) from its locked position.

5. A device of claim 1, characterized in that said projection means (23, 24) of the operating means (13) and of the locking piece (11) are arranged to hold the operating means (13) in the end position reached by its movement and to permit its return to the initial position upon a displacement of the locking piece (11) in its unlocking direction (33) when the cover is being closed.

6. A refuse container, which comprises a body and at least one cover, wherein it includes at least one gravity-activated compact device for locking the cover to the body, said device comprising a flat locking piece mounted for pivoting between a position assuring the locking of the cover in the closed position of the barrel and a position of unlocking for releasing the cover, and a flat operating means, which directly engages said locking piece in a common plane to bring the locking piece into an unlocked position at a predetermined inclined position of the container, said device characterized in that said operating means is a flat mobile weight (13), which is mounted for a guided translatory sliding movement in said common plane, and that said locking piece (11) and said operating means (13) include cooperating projecting means (24, 23) arranged so that a linear translatory movement in one direction (20, 26) of the operating means produces a rotation of the locking piece (11) in the unlocking direction (21, 27).

* * * * *